US005666976A

United States Patent [19]

Adams et al.

[11] Patent Number: 5,666,976

[45] Date of Patent: Sep. 16, 1997

[54] CIGARETTE AND METHOD OF MANUFACTURING CIGARETTE FOR ELECTRICAL SMOKING SYSTEM

[75] Inventors: John M. Adams, Mechanicsville; Mikhail S. Braunshteyn; Mary Ellen Counts, both of Richmond; Gerald M. Dale, Glen Allen; Charles W. Harris, Chesterfield; Donald H. Jones, Chesterfield; Billy J. Keen, Jr., Chesterfield; Wesley G. Sanderson, Richmond; Barry S. Smith, Hopewell; Brett W. Stevenson, Richmond; Susan E. Wrenn, Chesterfield, all of Va.

[73] Assignee: Philip Morris Incorporated, New York, N.Y.

[21] Appl. No.: 485,190

[22] Filed: Jun. 7, 1995

Related U.S. Application Data

[63] Continuation-in-part of Ser. No. 425,166, Apr. 20, 1995, which is a continuation-in-part of Ser. No. 380,718, Jan. 30, 1995, which is a continuation of Ser. No. 118,665, Sep. 10, 1993, Pat. No. 5,388,594, which is a continuation-in-part of Ser. No. 943,504, Sep. 11, 1992, Pat. No. 5,505,214.

[51] Int. Cl.[6] ..... A24C 5/00

[52] U.S. Cl. ..... 131/94; 131/194

[58] Field of Search ..... 131/280, 94, 194, 131/84.1, 359, 360, 361, 364

[56] References Cited

U.S. PATENT DOCUMENTS

| | | |
|---|---|---|
| 1,771,366 | 7/1930 | Wyss et al. . |
| 1,968,509 | 7/1934 | Tiffany . |
| 2,057,353 | 10/1936 | Whittemore . |
| 2,104,266 | 1/1938 | McCormick . |
| 2,442,004 | 5/1948 | Hayward-Butt . |

(List continued on next page.)

FOREIGN PATENT DOCUMENTS

| | | |
|---|---|---|
| 1202378 | 3/1966 | Canada . |
| 87/104459 | 2/1988 | China . |
| 0 438 862 | 7/1982 | European Pat. Off. . |
| 0 295 122 | 12/1988 | European Pat. Off. . |
| 0 358 002 | 3/1990 | European Pat. Off. . |
| 0 358 114 | 3/1990 | European Pat. Off. . |
| 0 430 566 | 6/1991 | European Pat. Off. . |
| 0 589 298 A1 | 3/1994 | European Pat. Off. . |
| 36 40 917 | 8/1988 | Germany . |
| 37 35 704 | 5/1989 | Germany . |
| 61-68061 | 4/1986 | Japan . |
| 2 132 539 | 7/1984 | United Kingdom . |
| 2 148 676 | 5/1985 | United Kingdom . |
| 2 148 079 | 5/1985 | United Kingdom . |
| 86/02528 | 5/1986 | WIPO . |

OTHER PUBLICATIONS

Excerpt from "NASA Tech Briefs," Jul./Aug. 1988, p. 31.

"PCT Thermistors," Keystone Carbon Company product literature.

U.S. application No. 07/443,636, filed Nov. 29, 1989.

*Primary Examiner*—Jennifer Bahr

*Attorney, Agent, or Firm*—Charles E. B. Glenn; James E. Schardt; Kevin B. Osborne

[57] ABSTRACT

A method of manufacturing cigarettes including the steps of establishing a succession of 2-up hollow plugs in alternating relation to 2-up tobacco plugs and wrapping same in a tobacco web and overwrap, severing the resultant continuous rod at mid points of preselected 2-up tobacco plugs and severing again to establish associated pairs of singular tobacco rod plugs, separating the members of associated pairs of tobacco rod plugs and placing 2-up filter tipping plugs therebetween, and subsequently wrapping the interposed 2-up filter tipping plug together with adjacent portions of the singular tobacco rod plugs and severing the resultant tipped structure into individual cigarettes. Also provided are cigarettes constructed in accordance with the novel method.

12 Claims, 8 Drawing Sheets

U.S. PATENT DOCUMENTS

| | | | |
|---|---|---|---|
| 2,974,669 | 3/1961 | Ellis . | |
| 2,979,058 | 4/1961 | Schur | 131/94 X |
| 3,122,974 | 3/1964 | Rowlands | 131/94 X |
| 3,200,819 | 8/1965 | Gilbert . | |
| 3,255,760 | 6/1966 | Selke . | |
| 3,303,832 | 2/1967 | Stelzer et al. | 131/94 X |
| 3,363,633 | 1/1968 | Weber . | |
| 3,402,723 | 9/1968 | Hu . | |
| 3,482,580 | 12/1969 | Hollabaugh . | |
| 3,608,560 | 9/1971 | Briskin et al. . | |
| 3,637,447 | 1/1972 | Berger et al. . | |
| 3,738,374 | 6/1973 | Bennett . | |
| 3,744,496 | 7/1973 | McCarty et al. . | |
| 3,804,100 | 4/1974 | Fariello . | |
| 3,889,690 | 6/1975 | Guarnieri . | |
| 4,016,061 | 4/1977 | Wasa et al. . | |
| 4,068,672 | 1/1978 | Guerra . | |
| 4,077,784 | 3/1978 | Vayrynen . | |
| 4,131,119 | 12/1978 | Blasutti . | |
| 4,141,369 | 2/1979 | Burruss . | |
| 4,164,230 | 8/1979 | Pearlman . | |
| 4,193,411 | 3/1980 | Faris et al. . | |
| 4,215,708 | 8/1980 | Bron . | |
| 4,219,032 | 8/1980 | Tabatnik et al. . | |
| 4,246,913 | 1/1981 | Ogden et al. . | |
| 4,256,945 | 3/1981 | Carter et al. . | |
| 4,259,970 | 4/1981 | Green, Jr. . | |
| 4,303,083 | 12/1981 | Burruss, Jr. . | |
| 4,319,591 | 3/1982 | Keith et al. . | |
| 4,393,884 | 7/1983 | Jacobs . | |
| 4,431,903 | 2/1984 | Riccio . | |
| 4,436,100 | 3/1984 | Green, Jr. . | |
| 4,463,247 | 7/1984 | Lawrence et al. . | |
| 4,505,282 | 3/1985 | Cogbill et al. . | |
| 4,562,337 | 12/1985 | Lawrence . | |
| 4,570,646 | 2/1986 | Herron . | |
| 4,580,583 | 4/1986 | Green, Jr. . | |
| 4,621,649 | 11/1986 | Osterrath . | |
| 4,623,401 | 11/1986 | Derbyshire et al. . | |
| 4,637,407 | 1/1987 | Bonanno et al. . | |
| 4,659,912 | 4/1987 | Derbyshire . | |
| 4,735,217 | 4/1988 | Gerth et al. . | |
| 4,771,796 | 9/1988 | Myer . | |
| 4,776,353 | 10/1988 | Lilja et al. . | |
| 4,837,421 | 6/1989 | Luthy . | |
| 4,846,199 | 7/1989 | Rose . | |
| 4,848,376 | 7/1989 | Lilja et al. . | |
| 4,874,924 | 10/1989 | Yamamoto et al. . | |
| 4,877,989 | 10/1989 | Drews . | |
| 4,922,901 | 5/1990 | Brooks et al. . | |
| 4,945,931 | 8/1990 | Gori . | |
| 4,947,874 | 8/1990 | Brooks et al. . | |
| 4,947,875 | 8/1990 | Brooks et al. . | |
| 4,966,171 | 10/1990 | Serrano et al. . | |
| 4,981,522 | 1/1991 | Nichols et al. . | |
| 4,991,606 | 2/1991 | Serrano et al. . | |
| 4,998,541 | 3/1991 | Perfetti et al. . | |
| 5,016,656 | 5/1991 | McMurtrie . | |
| 5,040,552 | 8/1991 | Nystrom et al. . | |
| 5,042,510 | 8/1991 | Curtiss et al. . | |
| 5,060,671 | 10/1991 | Counts et al. . | |
| 5,076,296 | 12/1991 | Schleich et al. . | |
| 5,093,894 | 3/1992 | Deevi et al. . | |
| 5,095,921 | 3/1992 | Losee et al. . | |
| 5,144,962 | 9/1992 | Counts et al. . | |
| 5,159,940 | 11/1992 | Hayward et al. . | |
| 5,179,966 | 1/1993 | Losee et al. . | |
| 5,235,157 | 8/1993 | Blackburn . | |
| 5,249,586 | 10/1993 | Morgan et al. . | |
| 5,269,327 | 12/1993 | Counts et al. . | |
| 5,274,214 | 12/1993 | Blackburn . | |
| 5,285,050 | 2/1994 | Blackburn . | |

CIGARETTE AND METHOD OF MANUFACTURING CIGARETTE FOR ELECTRICAL SMOKING SYSTEM

RELATED APPLICATIONS

The present application is a continuation-in-part of commonly assigned, copending patent application Ser. No. 08/425,166, filed Apr. 20, 1995, the latter being a continuation-in-part of commonly assigned, patent application Ser. No. 08/380,718, filed Jan. 30, 1995, which is a continuation of U.S. Pat. No. 5,388,594 which issued from Ser. No. 08/118,665, filed Sep. 10, 1993. Ser. No. 08/118,665 is a continuation-in-part of commonly assigned patent application Ser. No. 07/943,504, filed Sep. 11, 1992, which has issued as U.S. Pat. No. 5,505,214, all which are hereby incorporated by reference in their entireties.

FIELD OF INVENTION

The present invention relates generally to electrical smoking systems, and in particular cigarettes adapted to cooperate with electrical lighters of electrical smoking systems and automated methods of their manufacture.

BACKGROUND OF THE INVENTION

Traditional cigarettes deliver flavor and aroma to the smoker as a result of combustion, during which a mass of tobacco is combusted at temperatures which often exceed 800° C. during a puff. The heat of combustion releases various gaseous combustion products and distillates from the tobacco. As these gaseous products are drawn through the cigarettes, they cool and condense to form an aerosol which provides the tastes and aromas associated with smoking.

Traditional cigarettes produce sidestream smoke during smoldering between puffs. Once lit, they must be fully consumed or be discarded. Re-lighting a traditional cigarette is possible but is usually an unattractive proposition to a discerning smoker for subjective reasons (flavor, taste, odor).

An alternative to the more traditional cigarettes includes those in which a combustible material heats a separate bed of tobacco sufficiently to release an aerosol. Such cigarettes may comprise a combustible, carbonaceous heating element (heat source) located at or about one end of the cigarette and a bed of tobacco-laden elements located adjacent the aforementioned heating element. The heating element is ignited with a match or a fossil-fuel cigarette lighter. When a smoker draws upon the lit cigarettes heat generated by the heating element is drawn to the bed of tobacco-laden elements so as to cause the bed to release a tobacco aerosol. While this type of cigarette produces little or no sidestream smoke, it still generates products of combustion at the heat source, and once its heat source is ignited, the cigarette is not readily snuffed for future use in a practical sense. Commonly assigned U.S. Pat Nos. 5,388,594 and 5,505,214 disclose various heating disclose various heating elements and cigarettes which significantly reduce sidestream smoke while permitting the smoker to selectively suspend and reinitiate smoking.

The aforementioned, U.S. Pat. No. 5,388,594 describes an electrical smoking system including a novel electrically powered lighter and a novel cigarette that cooperates with the lighter. The preferred embodiment of the lighter includes a plurality of metallic serpentine heaters disposed in a configuration that slidingly receives a tobacco rod portion of the cigarette.

The preferred embodiment of the cigarette in U.S. Pat. No. 5,388,594 comprises a tobacco-laden tubular carrier, a cigarette paper overwrapped about the tubular carrier, an arrangement of flow-through filter plugs at a mouthpiece end of the carrier and a filter plug at the free (distal) end of the carrier. The cigarette and the lighter are configured such that when the cigarette is inserted into the lighter and as individual heaters are activated for each puff, localized charring occurs at spots about the cigarette in the locality where each heater was bearing against the cigarette (hereinafter referred to as a "heater footprint"). Once all the heaters have been activated, these charred spots are closely spaced from one another and encircle a central portion of the carrier portion of the cigarette.

When cut filler was included with the hollow structure of the cigarette in U.S. Pat. No. 5,388,594, it was discovered that such cigarettes when fully filled with cut filler tobacco tended to operate adequately in an electrical lighter for the first several puffs. Thereafter, its delivery would tend to taper off. The same phenomenon would tend to occur when more traditional cigarettes were smoked in an electrical lighter such as the electrical lighter disclosed in U.S. Pat. No. 5,388,594.

When left unfilled, the hollow cigarette structures of the preferred embodiments of U.S. Pat. No. 5,388,594 were also somewhat vulnerable to collapse from extreme or rough handling.

SUMMARY OF THE INVENTION

Accordingly, a primary object of the present invention is to provide a novel cigarette which contains cut filler and yet is operable with consistency when smoked as part of an electrical smoking system.

Another object of the present invention is to provide a cigarette containing cut filler, which cigarette is adapted to cooperate with an electrical lighter and render satisfying levels of taste and delivery.

Still another object of the present invention is to establish a method of manufacturing with high speed production machinery a cigarette of the type operable with an electric lighter and containing cut filler.

It is another object of the present invention to provide a cigarette suited for consumption with a lighter of an electrical smoking system and a method of manufacturing same, wherein the cigarette is not subjected to forces which would tend to collapse or break the cigarette during its manufacture.

It is still a further object of this invention to provide a novel cigarette that is operative with an electrical lighter and a cost-effective method of manufacturing the cigarette.

These objects and other advantages are provided by the present invention which provides a cigarette operable with an electrically operated lighter, which lighter includes a plurality of electrical heaters, with each of the heaters being adapted to, either singularly or in concert, to thermally release a predetermined quantity of tobacco aerosol from the cigarette upon its/their activation.

In accordance with one aspect of the present invention, the cigarette comprises a tubular tobacco web, wherein a first portion of the tubular tobacco web is filled with a column of tobacco, preferably in the form of cut filler, and a second portion of the tubular tobacco web is left unfilled or hollow so as to define a void in the tobacco column.

More particularly, the aforementioned cigarette preferably comprises a tobacco rod formed from a tubular tobacco web and a plug of tobacco located within the tubular tobacco web. The tobacco rod is adapted to be slidingly received by an electrical heater fixture such that the heater elements locate alongside the tobacco rod at a location between the free end and an opposite end of the tobacco rod. Preferably the plug (or column) of tobacco extends from the free end of the tobacco rod to a location that is spaced from the opposite end of the tobacco rod so as to define a void (or hollow portion) adjacent the opposite end.

The relative dimensions of the cigarette and the heater fixture of the lighter are determined such that upon insertion of the cigarette into the lighter, each heater will locate alongside the tobacco rod at a predetermined location along the tobacco rod and, preferably, such that the longitudinal extent of contact between the heater and the cigarette (hereinafter "heater footprint") superposes at least a portion of the aforementioned void and at least a portion of the plug of tobacco. In so doing, consistent and satisfactory delivery is obtained when the cigarette is electrically smoked, and condensation of tobacco aerosol at or about the heater elements is reduced.

In the alternative, the relative dimensions of the cigarette and the heater fixture of the lighter are determined such that upon insertion of the cigarette into the lighter, each heater will locate alongside the tobacco rod such that at least some, if not all of the heater footprints superpose only the filled portion of the tobacco rod (over the tobacco plug). In such configurations, the void may still be employed to facilitate aerosol formation and to help cool the smoke.

Preferably, a cigarette paper is wrapped about the tubular tobacco web so as to provide the appearance and feel of the more traditional cigarette during handling by the smoker.

The tobacco web preferably comprises a nonwoven tobacco base web and a layer of tobacco material located along at least one side of the tobacco base web.

The cigarette preferably also includes filter tipping at the aforementioned opposite end of the tobacco rod, which comprises a flow-through filter plug (also known in the art as "whistle-through" plugs), a mouthpiece filter plug and tipping paper attaching the plugs to the tobacco rod.

Still another aspect of the present invention is to provide a filler containing cigarette that is operative with an electrical lighter, which cigarette includes a tobacco rod having a free-flow filter and a filler-free rod portion adjacent the free flow filter so as to promote consistent aerosol production.

A preferred embodiment of the present invention provides a method of manufacturing such cigarettes, wherein the method comprises the steps of establishing a succession of 2-up hollow plugs in alternating, spaced apart relation to 2-up tobacco plugs and wrapping the succession of plugs in a tobacco web and overwrap so as to produce a continuous rod; severing the resultant continuous rod to establish associated pain of singular tobacco rod plugs; separating the members of each associated pair of singular tobacco rod plugs so as to establish a space therebetween; placing a 2-up filter tipping plug in the space between each a pair of separated, singular tobacco rod plugs; bringing the 2-up filter tipping plug and said singular tobacco rod plugs together into an abutting relation; and subsequently wrapping tipping paper about the placed 2-up filter tipping plug together with adjacent portions of the abutting singular tobacco rod plugs to form a 2-up cigarette rod; and severing the 2-up cigarette into individual cigarettes.

BRIEF DESCRIPTION OF THE DRAWING

Other objects, advantages and novel features of the present invention will become apparent from the following detailed description of the preferred embodiments when considered in conjunction with the accompanying drawings, wherein.

DETAILED DESCRIPTION OF THE PREFERRED EMBODIMENTS

Figure 1:
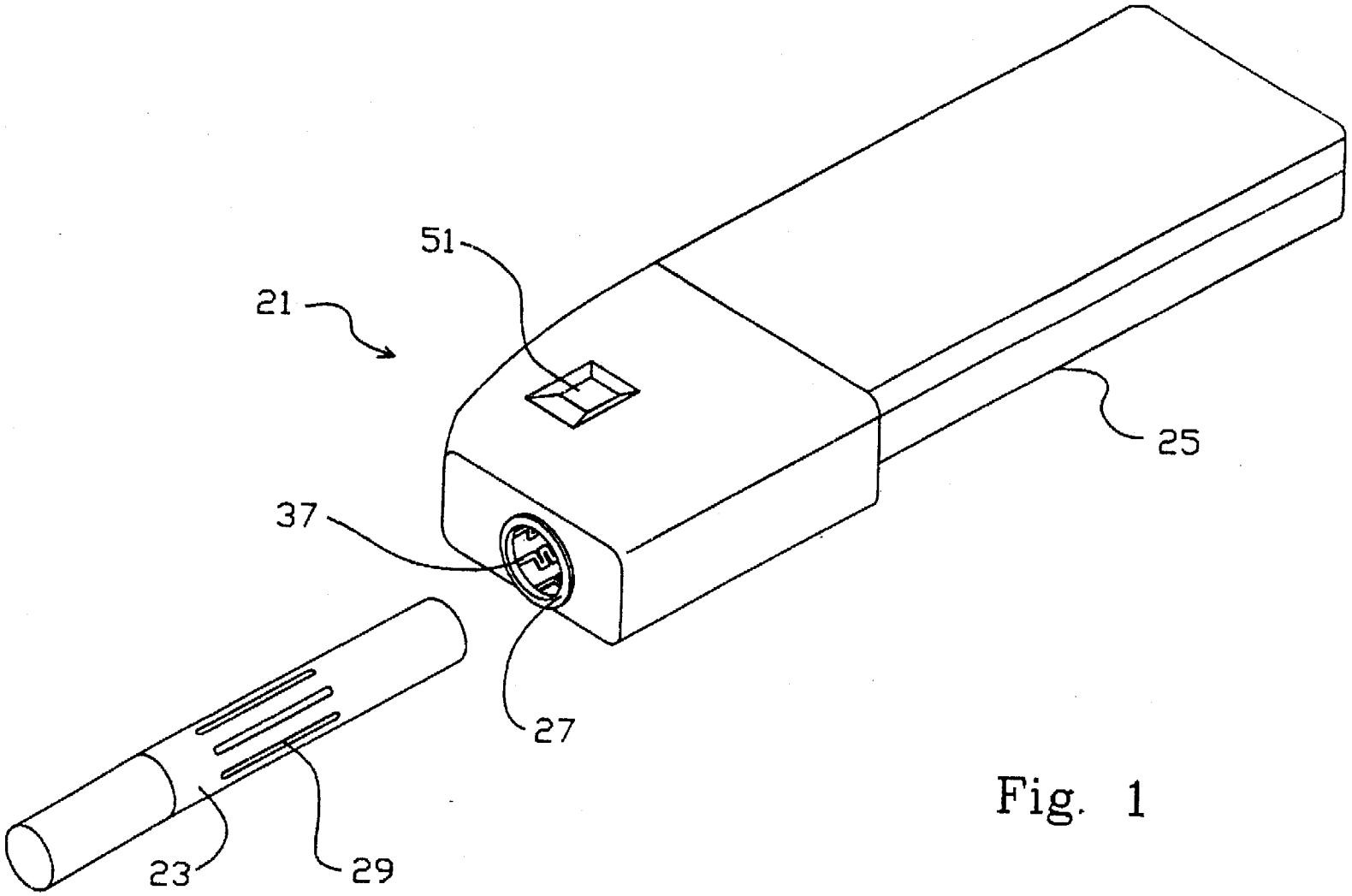
FIG. 1 is a perspective view of an electronic smoking system in accordance with a preferred embodiment of the present invention.
Figure 2:
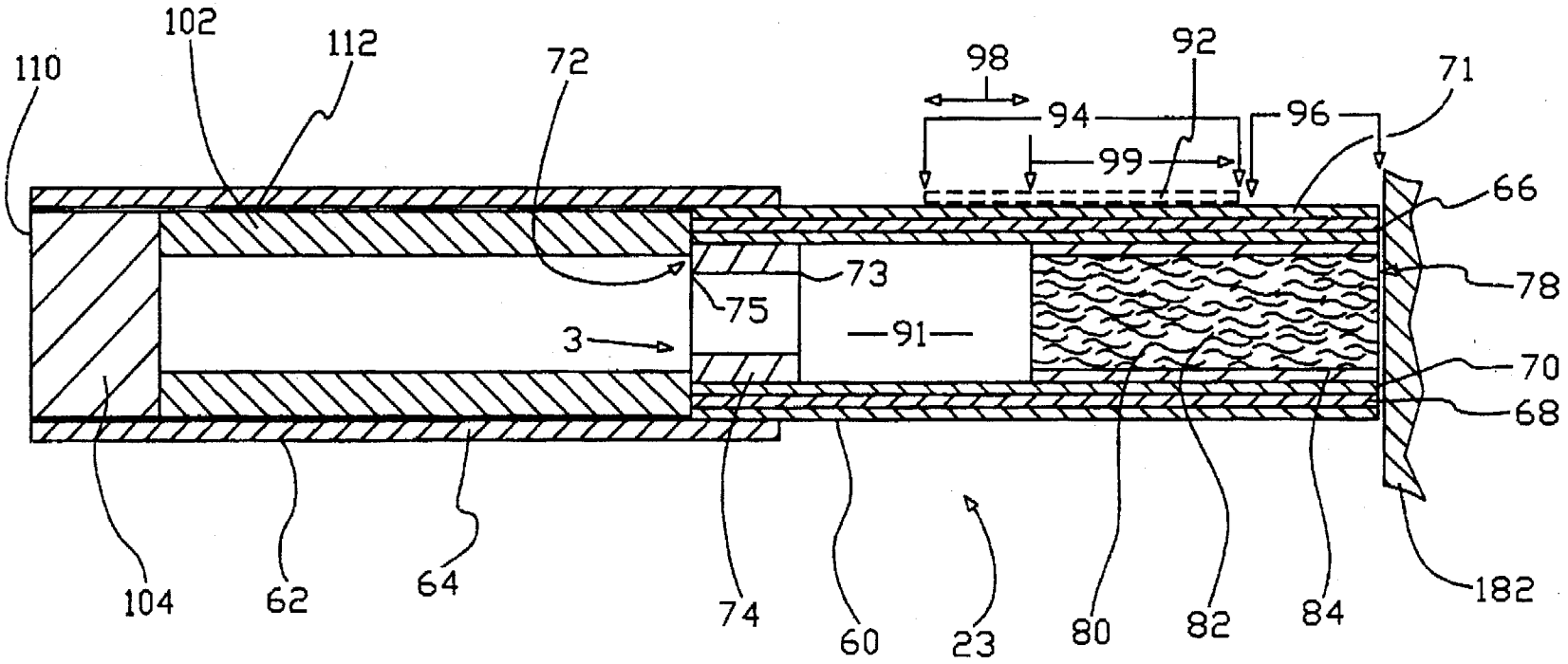
FIG. 2 is a sectional side view of a cigarette constructed in accordance with a preferred embodiment of the present invention.

Referring to FIGS. 1 and 2, a preferred embodiment of the present invention provides a smoking system 21 which includes a partially-filled, filler cigarette 23 and a reusable lighter 25. Details of both the cigarette 23 and the lighter 25 are set forth in, commonly assigned U.S. application Ser. No. 08/425,166 filed Apr. 20, 1995, which is incorporated herein by reference in its entirety.

The cigarette 23 is adapted to be inserted into and removed from a receptacle 27 at a front end portion 29 of the lighter 25. Once the cigarette 23 is inserted, the smoking system 21 is used in much the same fashion as a more traditional cigarette, but without lighting or smoldering the cigarette 23. The cigarette 23 is discarded after one or more puff cycles. Preferably, each cigarette 23 provides a total of eight puffs (puff cycles) or more per smoke; however it is a matter design expedient to adjust to a lesser or greater total number of available puffs.

The lighter 25 encloses one or more batteries (not shown) which supply energy to a plurality of electrically resistive, heating elements 37 which are arranged within the receptacle 27. A control circuit 41 in the housing establishes electrical communication between the batteries and each of the heater elements 37.

Preferably, the housing 31 has overall dimensions of about 10.7 cm by 3.8 cm by 1.5 cm. so that it may fit comfortably in the hand of a smoker.

The heaters 37 are each energized by the batteries in the lighter under the control of circuitry in the lighter 25 so as to heat the cigarette 23 preferably eight times at spaced locations 29 about the periphery of the cigarette 23. The heating renders eight puffs from the cigarette 23, as is commonly achieved with the smoking of a more traditional cigarette. It may be preferred to fire more than one heater simultaneously for one or more of the puffs.

Various alternate heater arrangements are set forth in co-pending, commonly assigned, U.S. patent application Ser. No. 08/224,848, filed Apr. 8, 1994 (PM 1729B), hereby incorporated by reference in its entirety.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display but other suitable arrangements are available.

Figure 3:
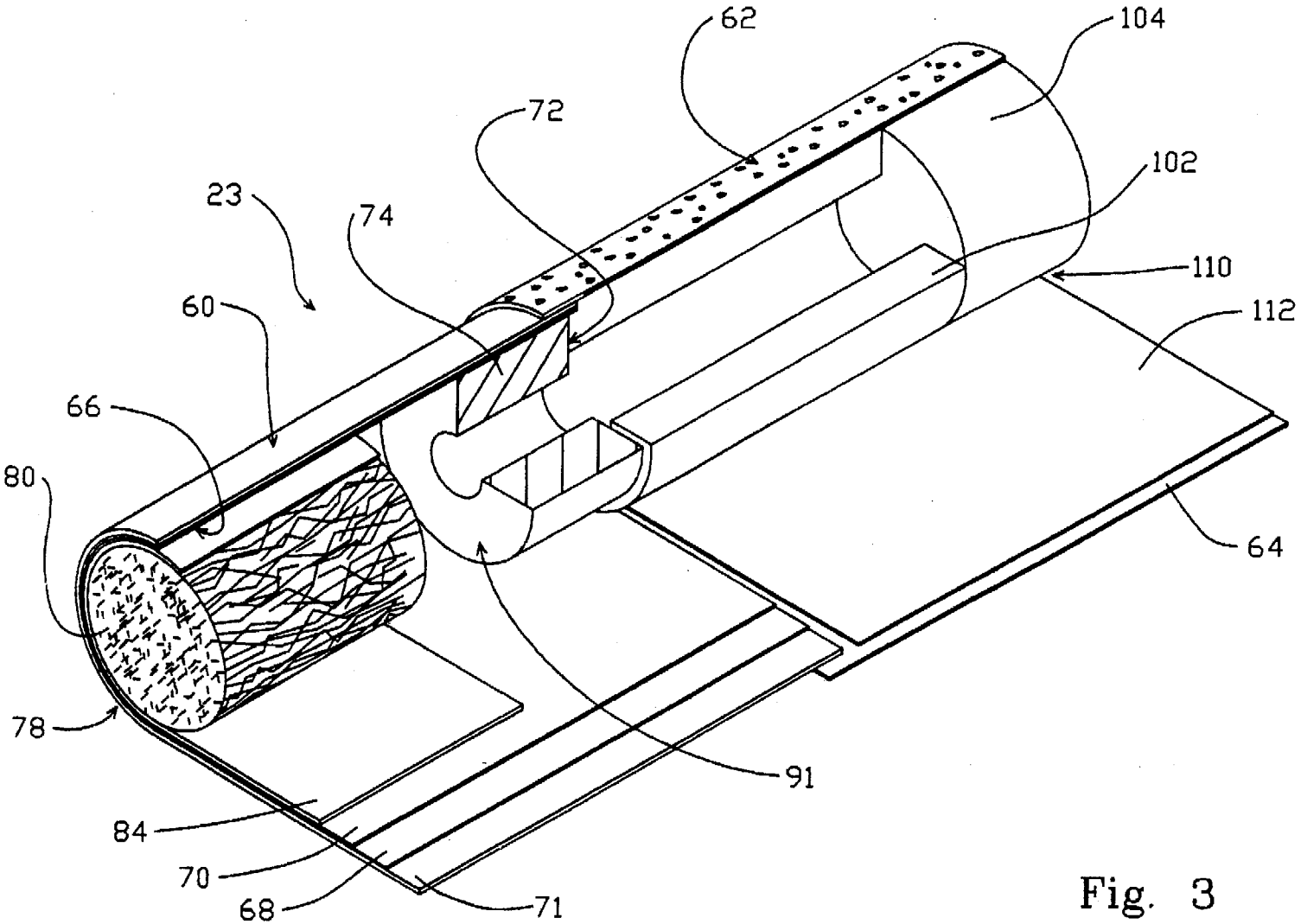
FIG. 3 is a detailed perspective view of the cigarette shown in FIG. 2, with certain components of the cigarette being partially unravelled.

Referring now to FIGS. 2 and 3, the cigarette 23, as constructed in accordance with the preferred embodiment of the present invention, comprises a tobacco rod 60 and a filter tipping 62, which are joined together with tipping paper 64.

The partially-filled, filler cigarette 23 preferably has an essentially constant diameter along its length and, which like more traditional cigarettes, is preferably between approximately 7.5 mm and 85 mm in diameter so that the smoking system 21 provides a smoker a familiar "mouth feel". In the preferred embodiment, the cigarette 23 is approximately 62 mm in overall length, thereby facilitating the use of conventional packaging machines in the packaging of the cigarettes 23. The combined length of the mouthpiece filter 104 and the free-flow filter 102 is preferably 30 mm. The tipping paper preferably extends approximately 6 mm over the tobacco rod 60. The total length of the tobacco rod 62 is preferably 32 mm. Other proportions, lengths and diameters may be selected instead of those recited above for the preferred embodiment.

The tobacco rod 60 of the cigarette 23 preferably includes a tobacco web 66 which has been folded into a tubular (cylindrical) form.

An overwrap 71 intimately enwraps the tobacco web 66 and is held together along a longitudinal seam as is common in construction of more traditional cigarettes. The overwrap 71 retains the tobacco web 66 in a wrapped condition about a free-flow filter 74 and a tobacco plug 80.

Preferably, the cigarette overwrap paper 71 is wrapped intimately about the tobacco web 66 so as to render external appearance and feel of a more traditional cigarette. It has been found that a better tasting smoke is achieved when the overwrap paper 71 is a standard type of cigarette paper, preferably a flax paper of approximately 20 to 50 CORESTA (defined as the amount of air, measured in cubic centimeters, that passes through one square centimeter of material, e.g., a paper sheet, in one minute at a pressure drop of 1.0 kilopascal) and more preferably of about 30 to 45 CORESTA, a basis weight of approximately 23 to 35 grams per meter squared ($g/m^2$) and more preferably about 23 to 30 $g/m^2$, and a filler loading (preferably calcium carbonate) of approximately 23 to 35% by weight and more preferably 28 to 33% by weight. The overwrap paper 71 preferably contains little or no citrate or other burn modifiers, with preferred levels of citrate ranging from 0 to approximately 2.6% by weight of the overwrap paper 71 and more preferably less than 1%.

The tobacco web 66 itself preferably comprises a base web 68 and a layer of tobacco flavor material 70 located along the inside surface of the base web 68. At the tipped end 72 of the tobacco rod 60, the tobacco web 66 together with the overwrap 71 are wrapped about the tubular free-flow filter plug 74. The free-flow filter 74 (also known in the art as "whistle-through" plugs) provides structural definition and support at the tipped end 72 of the tobacco rod 60 and permits aerosol to be withdrawn from the interior of the tobacco rod 60 with a minimum pressure drop. The free-flow filter 74 also acts as a flow constriction at the tipped end 72 of the tobacco rod 60, which is believed to help promote the formation of aerosol during a draw on the cigarette 23. The free-flow filter is preferably at least 7 millimeters long to facilitate machine handling and is preferably annular, although other shapes and types of low efficiency filters are suitable, including cylindrical filter plugs.

At the free end 78 of the tobacco rod 60, the tobacco web 66 together with the overwrap 71 are wrapped about a cylindrical tobacco plug 80. Preferably, the tobacco plug 80 is constructed separately from the tobacco web 66 and comprises a relatively short column of cut filler tobacco that has been wrapped within and retained by a plug wrap 84.

Preferably the tobacco plug 80 is constructed on a conventional cigarette rod making machine wherein cut filler (preferably blended) is air formed into a continuous rod of tobacco on a traveling belt and enwrapped with a continuous ribbon of plug wrap 84 which is then glued along its longitudinal seam and heat sealed. In accordance with the preferred embodiment of the present invention, the plug wrap 84 is preferably constructed from a cellulosic web of little or no filler, sizing or burn additives (each at levels below 0.5% weight percent) and preferably little or no sizing. Preferably, the tobacco plug wrap 84 has a low basis weight of below 15 grams per meter squared and more preferably about 13 grams per meter squared. The tobacco plug wrap 84 preferably has a high permeability in the range of about 20,000 to 35,000 CORESTA and more preferably in the range of about 25,000 to 35,000 CORESTA, and is constructed preferably from soft wood fiber pulp, abaca-type cellulose or other long fibered pulp. Such papers are available from Papierfabrik Schoeller and Hoescht GMBH, Postfach 1155, D-76584, Gernsback, GERMANY; another paper suitable for use as the plug wrap 84 is the paper TW 2000 from DeMauduit of Euimperle FRANCE, with the addition of carboxy-methyl cellulose at a 2.5 weight percent level.

The tobacco rod making machine is operated so as to provide a tobacco rod density of approximately 0.17 to 0.30 grams per cubic centimeter (g/cc), but more preferably in a range of at least 0.20 to 0.30 g/cc and most preferably between about 0.24 to 0.28 g/cc. The elevated densities are preferred for the avoidance of loose ends at the free end 78 of the tobacco rod 60. However, it is to be understood that the lower rod densities will allow the tobacco column 82 to contribute a greater proportion of aerosol and flavor to the smoke. Accordingly, a balance must be struck between aerosol delivery (which favors a low rod density in the tobacco column 82) and the avoidance of loose-ends (which favors the elevated ranges of rod densities).

The tobacco column 84 preferably comprises cut filler of a blend of tobaccos typical of the industry, including blends comprising bright, burley and oriental tobaccos together with, optionally, reconstituted tobaccos and other blend components, including traditional cigarette flavors. However, in the preferred embodiment, the cut filler of the tobacco column 84 comprises a blend of bright, burly and oriental tobaccos at the ratio of approximately 45:30:25 for the U.S. market, without inclusion of reconstituted tobaccos or any after cut flavorings. Optionally, an expanded tobacco component might be included in the blend to adjust rod density, and flavors may be added.

The continuous tobacco rod formed as described above is sliced in accordance with a predetermined plug length for the tobacco plug 80. This length is preferably at least 7 mm in order to facilitate machine handling. However, the length may vary from about 7 mm to 25 mm or more depending on preferences in cigarette design which will become apparent in the description which follows, with particular reference to FIGS. 4A and 4*b*.

As a general matter, the length 86 of the tobacco plug 80 is preferably set relative to the total length 88 of the tobacco rod 60 such that a void 90 is defined along the tobacco rod 60 between the free-flow filter 74 and the tobacco plug 80. The void 90 corresponds to an unfilled portion of the tobacco rod 60 and is in immediate fluid communication with the tipping 62 through the free flow filter 74 of the tobacco rod 60.

Referring particularly to FIG. 2, the length 86 of the tobacco plug 80 and its relative position along the tobacco rod 60 is also selected in relation to features of the heater elements 37. When a cigarette is properly positioned against a stop 182 within the lighter 25, a portion 92 of each heater element 37 will contact the tobacco rod 60 along a region of the tobacco rod 60. This region of contact is referred to as a heater footprint 94. The heater footprint 94 (as shown with a double arrow in FIG. 2) is not part of the cigarette structure itself, but instead is a representation of that region of the tobacco rod 60 where the heater element 37 would be expected to reach operative heating temperatures during smoking of the cigarette 23. Because the heating elements 37 are a fixed distance 96 from the stop 182 of the heater fixture 39, the heater foot print 94 consistently locates along the tobacco rod 60 at the same predetermined distance 96 from the free end 78 of the tobacco rod 60 for every cigarette 23 that is fully inserted into the lighter 25.

Preferably, the length of the tobacco plug 80, the length of the heater footprint 94 and the distance between the heater footprint 94 and the stop 182 are selected such that the heater footprint 94 extends beyond the tobacco plug 80 and superposes a portion of the void 90 by a distance 98. The distance 98 by which the heater footprint 94 superposes the void 91 (the unfilled portion of the tobacco rod 60) is also referred to as the "heater-void overlap" 98. The distance by which the remainder of the heater footprint 94 superposes the tobacco plug 80 is referred to as the "heater-filler overlap" 99.

The tipping 62 preferably comprises a free-flow filter 102 located adjacent the tobacco rod 60 and a mouthpiece filter plug 104 at the distal end of the tipping 62 from the tobacco rod 60. Preferably the free-flow filter 102 is tubular and transmits air with very little pressure drop. Other low efficiency filters of standard configuration could be used instead, however. The inside diameter for the free flow filter 96 is preferably at or between 2 to 6 millimeters and is preferably greater than that of the free flow filter 74 of the tobacco rod 60.

The mouthpiece filter plug 104 doses off the free end of the tipping 62 for purposes of appearance and, if desired, to effect some filtration, although it is preferred that the mouthpiece filter plug 104 comprise a low efficiency filter of preferably about 15 to 25 percent efficiency.

The free-flow filter 102 and the mouthpiece filter plug 104 are preferably joined together as a combined plug 110 with a plug wrap 112. The plug wrap 112 is preferably a porous, low weight plug wrap as is conventionally available to those in the art of cigarette making. The combined plug 110 is attached to the tobacco rod 60 by the tipping paper 64 of specifications that are standard and conventionally used throughout the cigarette industry. The tipping paper 64 may be either cork, white or any other color as decorative preferences might suggest.

Preferably, a cigarette 23 constructed in accordance with the preferred embodiment has an overall length of approximately 62 mm, of which 30 mm comprises the combined plug 110 of the tipping 62. Accordingly, the tobacco rod 60 is 32 mm long. Preferably, the free-flow filter 74 of the tobacco rod 60 is at least 7 mm long and the void 91 between the free-flow filter 74 and the tobacco plug 80 is preferably at least 7 mm long. In the preferred embodiment, the heater foot print 94 is approximately 12 mm long and located such that it provides a 3 mm heater-void overlap 98, leaving 9 mm of the heater foot print 94 superposing the tobacco plug 80.

It is to be understood that the length of the void 91 and the length of the tobacco plug 80 may be adjusted to facilitate manufacturing and more importantly, to adjust the smoking characteristics of the cigarette 23, including adjustments in its taste, draw and delivery. The length of the void 91 and the amount of heater-filler overlap (and heater-void overlap) may also be manipulated to adjust the immediacy of response, to promote consistency in delivery (on a puff-to-puff basis as well as between cigarettes) and to control condensation of aerosol at or about the heaters.

In the preferred embodiment, the void 91 (the filler-free portion of the tobacco rod 60) extends approximately 7 mm to assure adequate clearance between the heater foot print 94 and the free-flow filter 74. In this way, margin is provided such that the heater foot print 94 does not heat the free-flow filter 74 during smoking. Other lengths are suitable, for instance, if manufacturing tolerances permit, the void 91 might be configured as short as approximately 4 mm or less, or in the other extreme, extended well beyond 7 mm so as establish an elongate filler-free portion along the tobacco rod 60. The preferred range of lengths for the filler-free portion (the void 91) is from approximately 4 mm to 18 mm and more preferably 5 to 12 mm.

The base web 68 physically separates the heating elements 37 from the tobacco flavor material, transfers heat generated by the heater elements 37 to the flavor material 70, and maintains physical cohesion of the tobacco rod during handling, insertion into the lighter 25 and removal of the cigarette after smoking.

Figure 4:
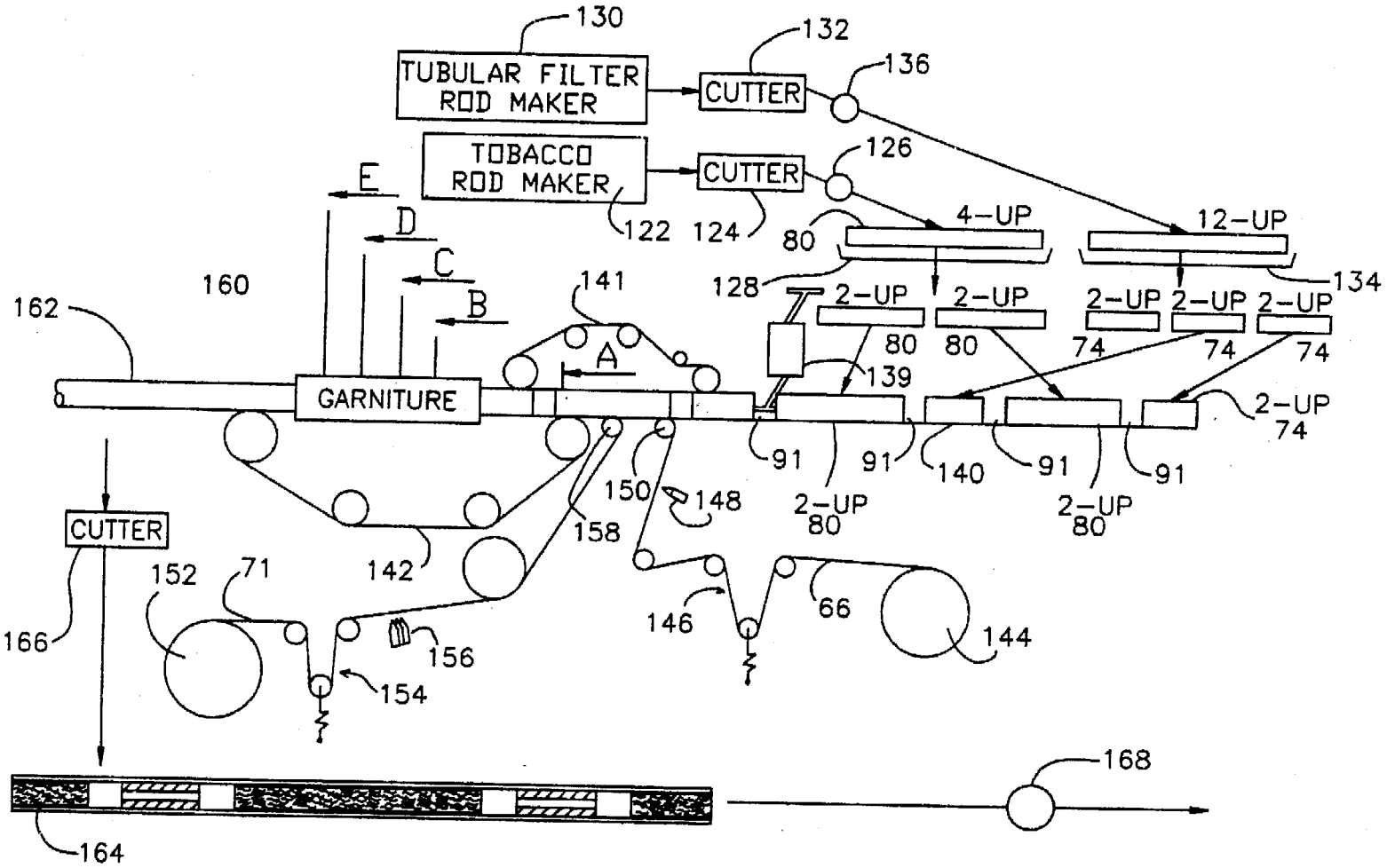
FIG. 4 is a representation of steps and apparatus in a preferred process of manufacturing tobacco rod portions of the cigarette shown in FIGS. 2 and 3 in accordance with a preferred method of manufacturing such cigarettes.

Referring to FIG. 4, a preferred method of manufacturing cigarettes 23 in accordance with a preferred embodiment of the present invention may initiate with the production of a plug comprising a multiple of tobacco plugs 80, preferably in a 4-up configuration and enwrapped with the plug wrap 84.

It is to be understood that referenced to a 4-up tobacco plug 80 refers to a plug construction such that if it were divided into four pieces, would render four complete tobacco plugs 80 of the preferred cigarette 23. Likewise, a 2-up tipping plug 62 would, if separated into 2 pieces, would provide a pair of tippings 62, each comprising free-flow filter 102, a mouth piece filter 104 and a plug wrap 112 as described in connection with the partially-filled cigarette 23 of the preferred embodiment. As a further example, a 2-up tobacco rod plug 60, if severed, would render two complete tobacco rods 60.

Referring back to FIG. 4, production of the 4-up tobacco rod plugs 60 initiates with the construction of 4-up tobacco plugs 80 and the establishment of a supply of 12-up free-flow filter plugs 74.

Preferably the tobacco plug 80 is constructed on a conventional cigarette rod making machine 122 (such as a Molins Mark 9 tobacco rod maker) wherein cut filler (preferably blended) is air formed into a continuous rod of tobacco on a traveling belt and enwrapped with a continuous ribbon of plug wrap 84 which is then glued along its longitudinal seam and heat sealed. The output of the tobacco rod maker 122 is then cut at a cutter 124 and delivered by a suitable arrangement 126 to a first hopper 128 of a combining machine such as a Molins double-action plug-tube combiner. The delivery arrangement 126 may include a HCF tray filler or some other equally suitable arrangement to load the first hopper 128 with the 4-up tobacco plugs 80. Other suitable plug delivery systems might be employed such as mass flow conveyors or pneumatic tubes or the like.

Similarly, the 12-up free-flow filter plugs 74 are produced in continuous fashion from a tubular filter rod maker 130, such as with a maker as described in U.S. Pat. No. 3,637,447 to Berger et al, particularly at column 4. The continuous rod of tubular filter material from the maker 130 is cut at a cutter 132 into the 6-up free-flow filter plugs 74 and delivered to a second hopper 134 of the Molins double-action plug-tube combiner ("DATPC") via a suitable delivery arrangement 136 which preferably comprises a HCF tray filler, although other delivery arrangements as previously described might be used instead.

From the first and second hopper 128, the 4-up tobacco plugs 80 are cut into 2-up plugs 80, while simultaneously, the 12-up free-flow filter plugs 74 from the second hopper 134 are cut into six 2-up free-flow filter plugs 74. These 2-up tobacco plugs 80 and 2-up free-flow filter plugs 74 are then placed in alternating relation to one another upon a conveyor 140 leading to a garniture belt 142. Such mechanical action can be provided at the front end of a Molins DAPTC combiner. The spacing between the 2-up tobacco plugs 80 and the 2-up free-flow filter plug 74 is set to equal the desired amount of void 91 desired in the tobacco rod 60 of the cigarette 27 being produced.

In most Molins DAPTC combiners, this spacing 91 between the 2-up plugs on the conveyor 140 is set precisely with a collator/spacer drum 139 located at or about the location where the compression belt 141 and the garniture belt 142 receive the 2-up free-flow filter plugs 74 and the 2-up tobacco plugs 80. Other suitable arrangements for assuring proper placement of the 2-up plugs 74 and the 2-up tobacco plugs 80 would be readily apparent to one of ordinary skill in the art of combining plugs.

Just upstream of the garniture belt 142, a continuous ribbon of tobacco web 66 is reeled from a bobbin 144 through a series of slack and tension controlling rollers generally designated 146 and past a glue applicator 148 prior to its arrival at the final roller 150, which then directs the ribbon of tobacco web 66 toward the path of the garniture belt 142.

Likewise a continuous ribbon of overwrap 71 is reeled from a bobbin 152 through an arrangement for adjusting slack and/or tension in the ribbon 71 generally designated 154, past a plurality of glue applicators 156 and then about a final roller 158 which directs the ribbon of overwrap 71 toward the path of the garniture belt 142 and between the garniture belt 142 and the tobacco web 66.

The 2-up tobacco plugs 80 and 2-up free-flow filter 74 are then moved into contact with the ribbons of tobacco mat 66 and the ribbon of overwrap 71 as the garniture belt 142 draws the tobacco mat 66 and the overwrap 71 through the garniture 160. During passage through the garniture 160, the continuous ribbon of tobacco web 66 and the overwrap 71 are folded about the spaced apart 2-up tobacco plugs 80 and the 2-up free-flow filter plugs 74 to produce a continuous rod 162 which is then cut at the cutter head of the DAPTC machine to produce plugs 164. The cutter head 166 is arranged to cut every other 2-up tobacco plug 80 so as to produce plugs 164 each comprising a 1-up tobacco plug 80 at one end, a space 91, a 2-up free-flow filter 74, a space 91, a 2-up tobacco plug 80, a space 91, a 2-up free-flow filter 74, a space 91 and a 1 -up tobacco plug 80 at the opposite end of the plug 164. Accordingly, the plug 164 is a 4-up tobacco rod 60. The 4-up tobacco rod plug 164 are delivered through an appropriate delivery arrangement 168 which preferably comprises HCF tray filler.

Figure 5A:
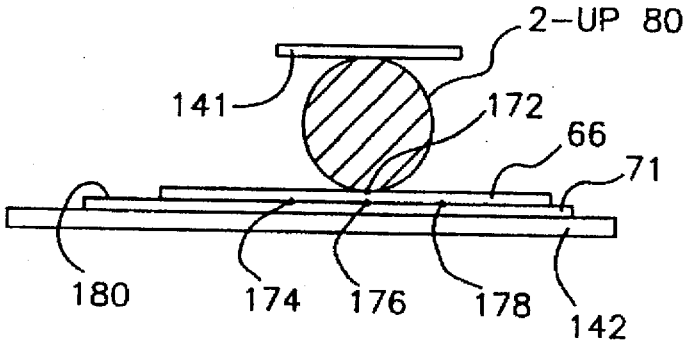
FIG. 5A–5E are successive cross-sectional views at lines A—A to E—E, respectively at the garniture in FIG. 4, as components of the cigarette shown in FIGS. 2 and 3 progress through the garniture.
Figure 5B:
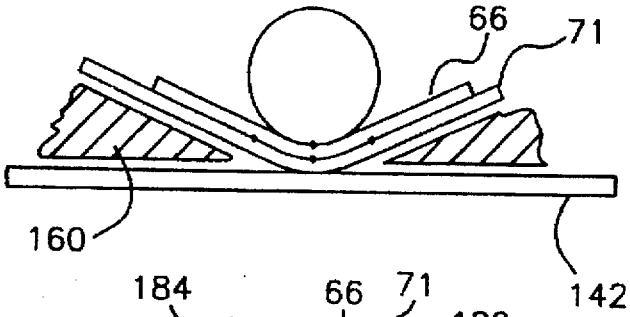
Figure 5C:
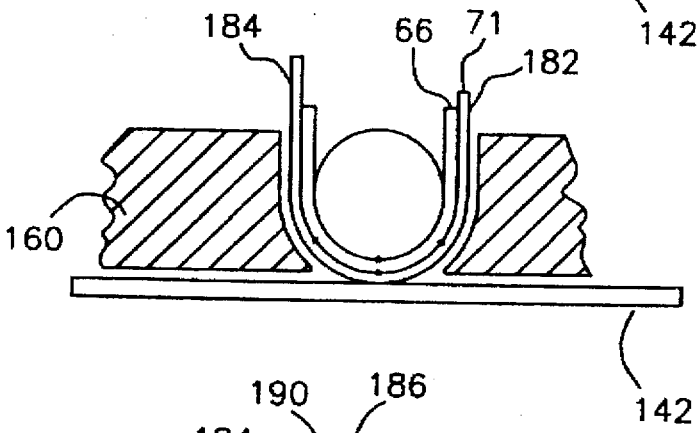
Figure 5D:
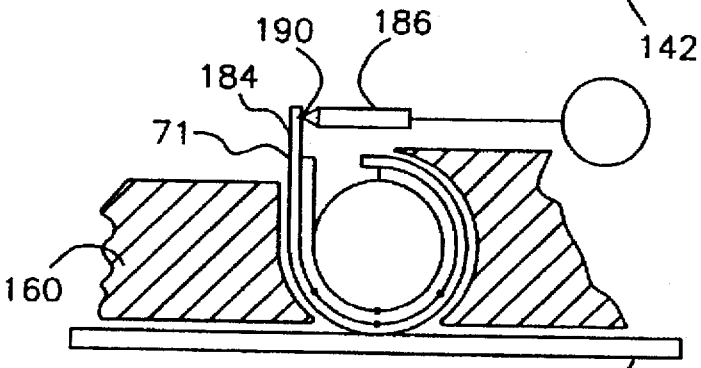
Figure 5E:
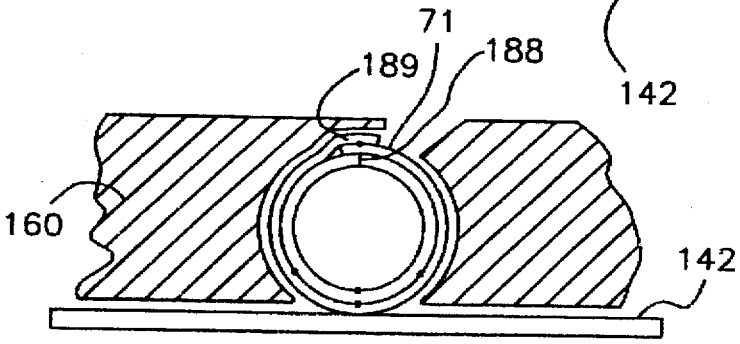

Referring back to the garniture 160 of FIG. 4 and in specific reference to FIGS. 5–5E, as the various components of the tobacco rod 60 are pulled through the garniture 160, a progression of folding steps wraps the continuous ribbon of tobacco mat 66 and the continuous ribbon of overwrap 71 about the alternating succession of 2-up plugs 80 and 74.

Referring now to FIG. 5A, upon their arrival at the garniture belt 142, the plugs 74 and 80, the tobacco web 66 and the overwrap 71 are urged against one another and the garniture belt 142 by the compression belt 141. A continuous bead of adhesive 172 is located at or about the center region of the continuous ribbon of tobacco web 66 as applied by the glue applicator 148. This bead of adhesive 172 anchors the 2-up tobacco plugs 80 and 2-up free-flow filter plugs 74 to the ribbon of tobacco web 66.

Likewise, the plural glue applicators 156 lay down continuous beads of adhesive 174, 176 and 178 on the side 180 of the continuous ribbon of overwrap 71 which is to come into contact with the continuous ribbon of tobacco web 66 at the garniture 160. It is preferred practice that these "laminating" beads of adhesive 174, 176 and 178 are not allowed to set prior to entry into the garniture 160 so the tobacco web 66 and the overwrap 71 may slip slightly relative to one another as they are folded about the 2-up plugs 80 and 74 in the garniture 160. This provision for at least some "give" avoids breaks and tears in the materials.

Referring now to FIGS. 5B and 5C, the garniture 160 progressively folds the continuous ribbon of tobacco web 66, together with the continuous ribbon of overwrap 71 about the 2-up plugs 74 and 80. It is to be noted that the relative placements of the tobacco web 66 and the overwrap 71 are slightly offset from one another so that along one side of the plugs 74 and 80 an edge portion 182 of the overwrap 71 extends only slightly beyond the adjacent edge of the tobacco mat 66, preferably at about 1 millimeter or so, whereas along an opposite side the plugs 74 and 80, an edge portion 184 of the overwrap 71 extends at least several millimeters beyond the adjacent edge of the tobacco web 66. Such provision, allows for the application of a bead of adhesive along the edge portion 184 by a glue applicator 186 as shown in FIG. 5D, prior to the edge portion 184 being folded completely down and over the plugs 74 and 80 as shown in FIG. 5E to form a seam 189.

It is to be noted that the tobacco web 66 is folded such and its width is selected such that it does not overlap upon itself at its seam 188. Preferably, no adhesive is applied at or about the seam 188 of the tobacco web 66 so as to minimize the application of adhesive to the structure of the tobacco rod structure 60.

It has also been found effective to locate the laminating adhesive beads 174, 176 and 178 at 4 o'clock, 6 o'clock and 8 o'clock positions relative to the cross-sectional form of the 2-up plugs 74 and 80 at the garniture 160.

The preferred adhesive for all adhesive beads 174, 176, 178, 172 and 190 is a liquid starch adhesive such as obtainable from National Starch. The bead of adhesive 190 is sufficiently broad to retain the tobacco web 66 in its completely folded condition.

Figure 6:
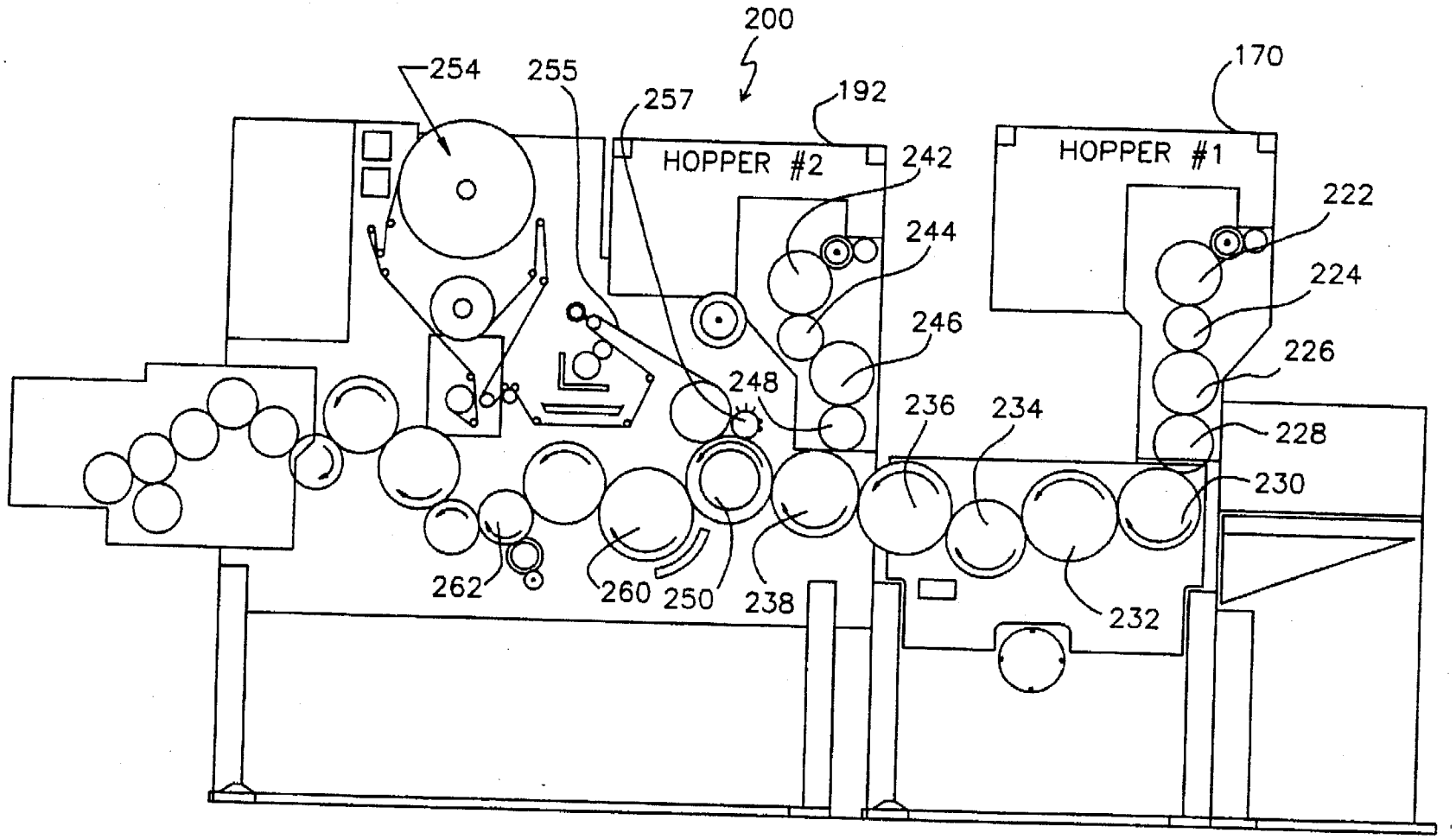
FIG. 6 is a diagram of a tipping apparatus which is adapted to attached filter tipping to the tobacco road portions produced in accordance with the process in FIG. 4.

As previously mentioned, the output of the Molins DAPTC combiner is a 4-up tobacco rod plug 164 which through a tray filler 168, is provided to a first hopper 170 of a cigarette tipping machine 200 such as a Hauni Max that has been modified to operate in the manner as described with reference to FIG. 7. The layout of the modified Hauni Max is shown in FIG. 6. Of course other tipping machines or the like could be arranged to execute the steps of cigarette manufacture that are described below.

Figure 7A:
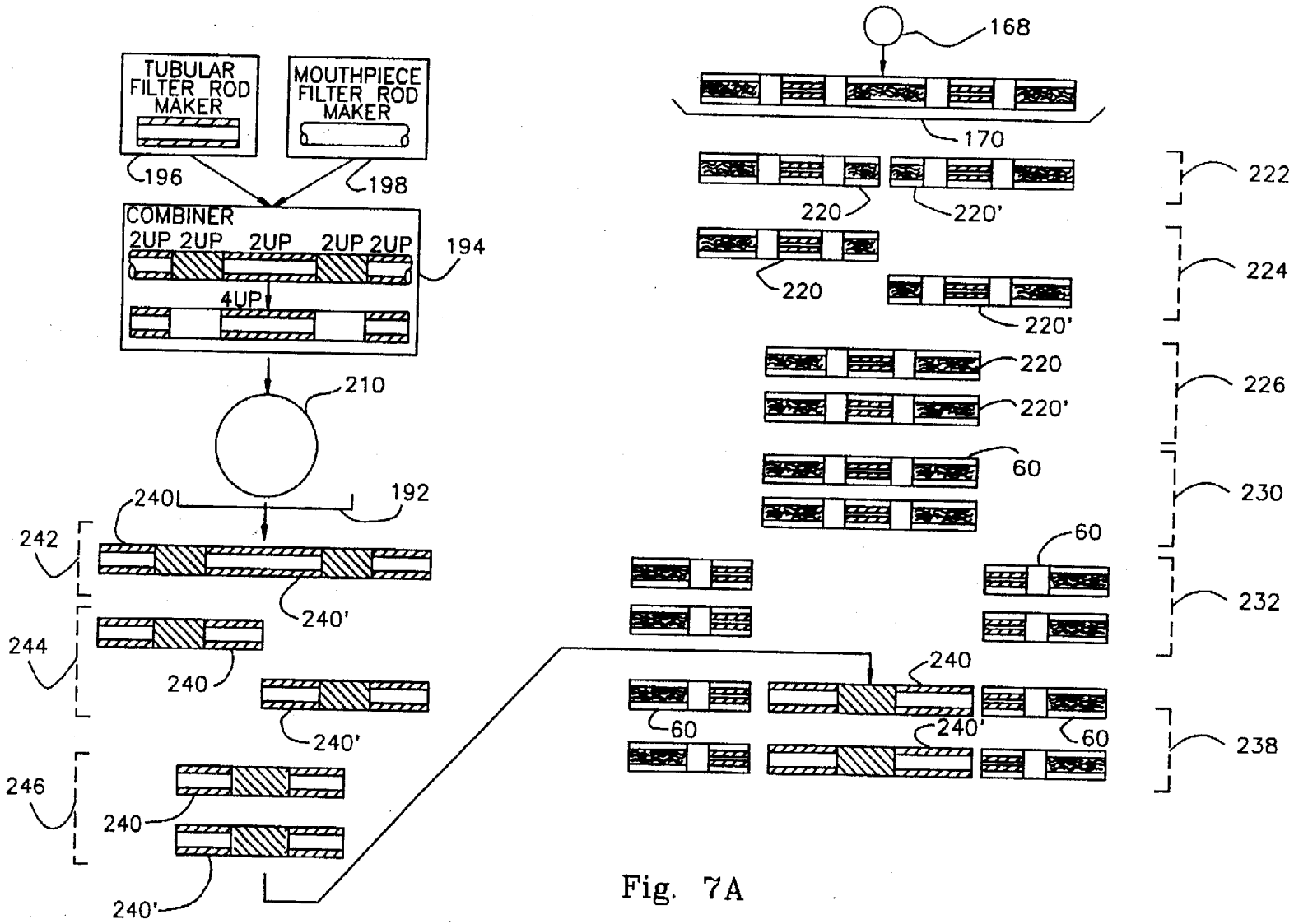
FIG. 7A and 7B are a diagram showing the relative movement and placement of cigarette pieces during execution of the tipping operation of the preferred method of manufacturing cigarettes of the type shown in FIGS. 2 and 3.
Figure 7B:
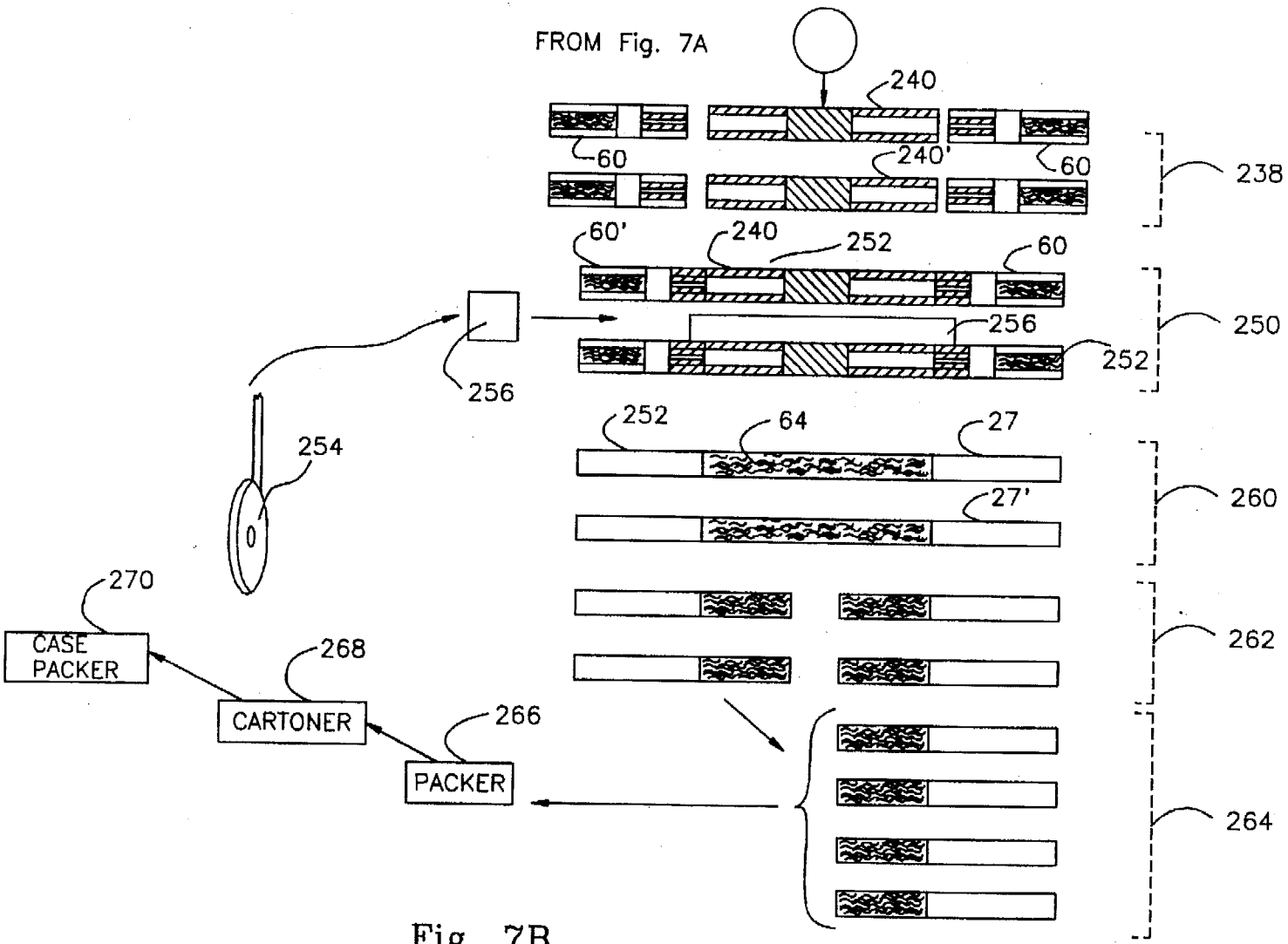

Referring now to FIGS. 6 and 7A and B, a second hopper 192 of the tipping machine 200 receives 4-up tipping plugs 62 which are the product of a combining operation 194, wherein 2-up free-flow filter plugs 102 from a tubular filter rod maker 196 and 2-up mouthpiece filter plugs 104 from another filter rod maker 198, such as a KDF-2, are combined, together with plug wrap 112, to produce the aforementioned 4-up tipping plugs 62 (a plug which when severed into four pieces provide four tippings 62, each comprising a free-flow filter 102, a mouthpiece filter 104 and plug wrap 112). The 4-up tipping plugs 62 are delivered to the hopper 192 of the tipping machine 200 by suitable delivery arrangement which preferably includes a tray filler 210.

The description of further steps in the preferred method of producing the cigarettes 27 will now be described with reference to the relative movement and position of the cigarette components as shown in FIGS. 7A and B, with cross-reference to respective drum stations along the mechanical pathway of the machine 200 as shown in FIG. 6. FIGS. 7A and B includes dashed lines that bear designations which correlate to drums in the machine 200 of the same designation.

As the 4-up tobacco rod plugs 164 are withdrawn from the first hopper 170, the plugs 164 are cut into two, 2-up tobacco rod plugs 220 and 220' as the plugs 164 progress through a first cutter drum 222 of the tipping machine 200. The 2-up tobacco rod plugs 220 and 220' are graded at a grading drum 224 (wherein one plug is positioned forward yet still offset from the other) and subsequently aligned at an alignment drum 226 (wherein one plug is positioned forward, parallel to and in-line from the other). An accelerator drum 228 then accelerates the aligned plugs 220 and 220' onto a second cutter drum 230 where each of the 2-up tobacco rod plugs 220 and 220' are severed into singular (1-up) tobacco rod pieces 60. Accordingly, at the exit of the second cutter drum 230, there remain two pairs of tobacco rods 60 with one pair aligned with the other pair, and with the free-flow filters 74 of each tobacco rod 60 facing each other within each pair.

The singular tobacco rods 60 within each pair are then separated from one another in paired relation on a separating drum 232. First and second transferred drums 234 and 236 then transfer the separated pairs of tobacco rod pieces 60 to a feed drum 238.

Meanwhile, back at the second hopper 192, 4-up tipping plugs 62 are delivered onto a third cutting drum 242 and cut into two, 2-up tipping plugs 240 and 240'. Each 2-up tipping plug 240 comprises a 1-up free-flow filter 102 at one end, a centrally located 2-up mouthpiece filter 104 and another 1-up free-flow filter 102 at the other end end of the 2-up tipping plug 240.

The 2 two-up tipping plugs 240 and 240' are then graded at a second grading drum 244 and aligned on a second alignment drum 246. The aligned two-up tipping plugs 240 and 240' are then transferred through an accelerator drum 248 onto a central portion of the feed drum 238 so as to locate the 2-up tipping plugs 240 and 240' centrally between the pairs of separated tobacco plugs 60. At the conclusion of this operation, on each flute of the transfer drum 238, the free ends of the free-flow filters 102 of a 2-up tipping plug face the free-flow filters 74 of a separated pair of tobacco rods 60.

Next, the aforementioned components placed at the feed drum 238 are transfered to a swash-plate drum 250 whose outer rail pushes the associated pairs of tobacco rods 60 into abutting relationship with the respective 2-up tipping plug 240 situated therebetween. Meanwhile, a continuous ribbon of tipping paper is drawn from a bobbin 254 and directed through a glue applicator 255 and severed into double-wide pieces 256 at a cutter 257. Once the cigarette components are positioned by the swash plate, an edge-portion of a double-wide piece of tipping paper 64 is attached to the respective 2-up tipping plug 240 and abutting portions of the pair of tobacco rods 60 so as to initiate connection of these components to form 2-up cigarette rods 252. The tipping operation is then continued on a roll drum 260 which rolls the the double-wide pieces of tipping paper 256 about the 2-up cigarette rods 252. The rods 252 are then cut in two at a final cut drum to 262 to produce a pair of cigarettes 27 and 27' from each of the rods 252. At a turning drum 264, one of the cigarettes 27 is turned and aligned with the other cigarette 27'.

The continuous stream of cigarettes 27 produced from the tipping machine 200 is then directed to packers 266 and cartoners 268 and finally case packers 270 for shipment from the manufacturing facilities.

It is to be understood that the present invention may be embodied in other spedfic forms and process the use without departing from the spirit or essential characteristics of the present invention. For example, the cutting and slitting operations may be reconfigured to cut different multiples of plugs. Although the disclosure specifies certain machines as being preferred, one of ordinary skill in the art, once familiar with these teachings, would be able to select other machines for executing the disclosed process. Additionally, certain plug structures might be altered such as replacing tubular plugs with those that may have a filled central portion. The scope of the invention is indicated by the appended claims rather than by the forgoing descriptions and all changes and variations which fall within the meaning and range of the claims are intended to be embraced therein.

What is claimed is:

1. A method of manufacturing cigarettes having a tobacco rod portion and a filter tipping portion, said tobacco rod portion comprising a tobacco plug at one end and a tubular element at an opposite end and a void between said tobacco plug and tubular element, said method comprising the steps of:

forming a continuous tobacco rod by placing 2-up tobacco plugs and 2-up hollow plugs in spaced, alternating relation from one another and wrapping a tobacco web and an overwrap about said spaced apart plugs;

severing said continuous rod at a mid-point of selected ones of consecutive tobacco plugs so as to form a plurality of 2-up tobacco rod portions;

establishing an associated pair of individual tobacco rod portions by severing at least one of said 2-up tobacco rod portions;

separating said associated pair of individual tobacco rod portions so as to define a space axially disposed between said separated singular tobacco rod portions;

establishing 2-up filter tipping plugs;

establishing 2-up cigarette rods by interposing said established 2-up filter tipping plugs between said separated, associated pair of individual tobacco rod portions, by bringing said individual tobacco rod portions and said interposed 2-up filter tipping plug into abutting relationship and by subsequently wrapping a tipping paper about said 2-up filter tipping plug and adjacent portions of said abutting, pair of individual tobacco rod portions; and severing the 2-up cigarette rod into individual cigarettes.

2. The method of manufacturing cigarettes as claimed in claim 1, wherein said step of wrapping tobacco web and overwrap comprises the steps of directing a ribbon of tobacco mat and a ribbon of overwrap together with a continuous succession of alternating spaced apart tobacco and hollow plugs through a garniture such that the tobacco web is wrapped immediately about the tobacco and hollow plugs and the overwrap is wrapped about the tobacco mat.

3. The method as claimed in claim 2, wherein a anchoring bead of adhesive is applied along a side of the tobacco web which contacts said tobacco and hollow plugs.

4. The method as claimed in claim 3, wherein said wrapping step includes applying a plurality of laminating beads of adhesive to a side of the overwrap which contacts the tobacco web upon completion of the wrapping step.

5. The method as claimed in claim 4, wherein said adhesive applying steps are proximate in time to completion of the wrapping step so as to permit relative movement between said tobacco web and said overwrap during said wrapping step.

6. The method as claimed in claim 4, wherein said wrapping step includes application of adhesive along one edge portion of the overwrap and folding said first edge portion over an opposite edge portion of the overwrap to form a seam along the continuous tobacco rod.

7. The method as claimed in claim 6, wherein opposing edge portions of the tobacco web are folded into an abutting relationship, said tobacco web being retained in its folded condition by said seam along the edge portions of the overwrap.

8. A cigarette constructed in accordance with claim 1.

9. A cigarette constructed in accordance with the method of claim 7.

10. A cigarette comprising a tobacco rod portion and a filter tipping portion, said tobacco rod portion and filter tipping portion attached by a tipping paper so as to define a tipped end of said tobacco rod portion;

said tobacco rod portion comprising a tobacco plug at a second end of said tobacco rod portion, a tubular element at the tipped end of said tobacco rod portion, a tobacco web wrapped about said tobacco plug and said tubular element and an overwrap wrapped about said tobacco web;

said tobacco rod including a bead of adhesive between said tobacco plug and said tobacco web, said first bead of adhesive adhering said tubular plug and said tobacco plug to said tobacco web;

said overwrap including a seam along said tobacco rod whereat an edge portion of said overwrap overlaps an opposite edge portion of said overwrap, said seam including a bead of adhesive between said overlapping edge portions of said overwrap;

said tobacco web having opposite edge portions folded into opposing edge to edge relation along said tobacco rod portion, said overwrap retaining said tobacco web in its folded condition.

11. The cigarette as claimed in claim 10, wherein said opposing edge portions of said tobacco web are situated adjacent to said seam of said overwrap.

12. A method of manufacturing cigarettes comprising the steps of:

establishing a succession of 2-up hollow plugs in alternating relation to 2-up tobacco plugs and wrapping said succession of plugs in a tobacco web and overwrap so as to produce a continuous rod;

cutting the resultant continuous rod to establish associated pairs of singular tobacco rod plugs;

separating the members of each associated pair of singular tobacco rod plugs so as to establish a space between each associated pair of singular tobacco rod plugs;

placing a 2-up filter tipping plug in said space between each a pair of separated, singular tobacco rod plugs;

bringing said 2-up filter tipping plug and said singular tobacco rod plugs together into abutting relation;

subsequently wrapping tipping paper about said placed 2-up filter tipping plug and about adjacent portions of said abutting singular tobacco rod plugs to form a 2-up cigarette; and severing the 2-up cigarette into individual cigarettes.

* * * * *